US011319110B2

(12) United States Patent
Aboabdo

(10) Patent No.: US 11,319,110 B2
(45) Date of Patent: May 3, 2022

(54) CONNECTABLE SAFETY CONTAINERS

(71) Applicant: Chubby Gorilla, Inc., Santa Fe Springs, CA (US)

(72) Inventor: Ibrahiem H. Aboabdo, Yorba Linda, CA (US)

(73) Assignee: Chubby Gorilla, Inc., Santa Fe Springs, CA (US)

( * ) Notice: Subject to any disclaimer, the term of this patent is extended or adjusted under 35 U.S.C. 154(b) by 419 days.

(21) Appl. No.: 16/413,348

(22) Filed: May 15, 2019

(65) Prior Publication Data

US 2020/0361658 A1 Nov. 19, 2020

(51) Int. Cl.

| | |
|---|---|
| ***B65D 21/02*** | (2006.01) |
| ***B65D 50/00*** | (2006.01) |
| ***B65D 41/46*** | (2006.01) |

(52) U.S. Cl.

CPC ..... *B65D 21/0204* (2013.01); *B65D 41/46* (2013.01); *B65D 50/00* (2013.01)

(58) Field of Classification Search

CPC .... B65D 21/0204; B65D 41/32; B65D 41/40; B65D 41/46; B65D 43/0256; B65D 50/045; B65D 50/00; B65D 50/06; B65D 50/066; B65D 50/069

See application file for complete search history.

(56) References Cited

U.S. PATENT DOCUMENTS

| | | | | |
|---|---|---|---|---|
| 4,328,902 | A | 5/1982 | North | |
| 4,650,256 | A | 3/1987 | Wetzinger | |
| 4,685,565 | A | 8/1987 | Sparling | |
| 4,790,443 | A | 12/1988 | Auer | |
| 5,024,067 | A | 6/1991 | Maier, II | |
| 5,031,784 | A * | 7/1991 | Wright | B65D 50/045 215/216 |
| 5,503,288 | A | 4/1996 | Conconi | |
| 6,830,236 | B2 | 12/2004 | Augusto de Lorenzo | |
| 2009/0090647 | A1 | 4/2009 | Panchal et al. | |
| 2016/0068303 | A1 | 3/2016 | Schroeder et al. | |
| 2016/0229107 | A1 | 8/2016 | Hendrickson et al. | |
| 2016/0367055 | A1 | 12/2016 | Rausch et al. | |
| 2017/0081076 | A1 | 3/2017 | Meroz | |
| 2017/0217634 | A1 | 8/2017 | Hendrickson et al. | |

* cited by examiner

*Primary Examiner* — Andrew T Kirsch

(74) *Attorney, Agent, or Firm* — Knobbe, Martens, Olson & Bear, LLP

(57) ABSTRACT

A linkable child-proof safety container that includes corresponding slide locks.

19 Claims, 13 Drawing Sheets

CONNECTABLE SAFETY CONTAINERS

BACKGROUND

Field

This disclosure generally relates to small connectable safety containers.

Related Art

Safety containers can be used to store hazardous or sensitive articles. Safety containers are designed to prevent access to the contents of the container by those who lack sufficient manual dexterity and/or know-how to open the container (e.g., children). On the other hand, safety containers are designed allow access to the contents of the container without undue damage to the container or effort by the user.

Safety containers can also be interlinked. Interlinking containers can be coupled with other similarly sized and/or shaped containers to form a linked set of container units. The linked sets can contain the components of a group of related articles. The related articles can be related to each other in a logical or functional manner. For example, U.S. Patent Publication No. 2016/0068303 describes a linked set of container units for storing liquid, solid and/or gas toiletry articles.

SUMMARY

One aspect of the connectable safety container is the connectable safety container can connect with other connectable safety containers to form a linked set of container units. In a retail or storage environment it can be very useful to form a linked set of container units. Each of container units can store a number of articles. The articles can be logically or functionally associated with each other. In some applications, the linked set of container units can be sold or stored as a unit and/or the container units can be sold individually. The individually sold container units can be assembled into a the linked set of container units.

In some implementations, the linked set of container units can have any number of container units. For example the container units can be connected in series. In some implementations, the number of container units in the linked set is only limited by limitations of the space available for storing the set of containers. In some implementations, the container units can be connectable with adjacent container units on opposite and/or adjacent sides of the container units.

In another aspect, the connectable safety containers can include access safety features. The access safety features can make it difficult for some persons (e.g., young children) to open the connectable safety containers and access the contents contained therein. The access safety feature can be a lock mechanism. The lock mechanism can require manual dexterity and/or know-how to be able to access the contents of the container. The access safety feature can require actuating various parts of the safety container in in a series of steps or simultaneous steps to enable the container to be opened successfully.

Another aspect of the connectable safety container is a tamper indicator feature. The tamper indicator feature can be a feature of the container that has to be damaged, removed, or otherwise modified in order to open the connectable safety container and access the contents therein. The tamper evident feature can be incorporated into the access safety mechanism. The tamper evident feature can be used in a retail or other environment where it is important to know whether the connectable safety container has been previously accessed.

Possible applications for the connectable safety containers contained herein include vaping-related devices or fluids.

The foregoing summary is illustrative only and is not intended to be limiting. Other aspects, features, and advantages of the systems, devices, and methods and/or other subject matter described in this application will become apparent in the teachings set forth below. The summary is provided to introduce a selection of some of the concepts of this disclosure. The summary is not intended to identify key or essential features of any subject matter described herein

BRIEF DESCRIPTION

Various implementations are depicted in the accompanying drawings for illustrative purposes, and should in no way be interpreted as limiting the scope of the implementations. Various features of different disclosed implementations can be combined to form additional implementations, which are part of this disclosure.

DETAILED DESCRIPTION

The various features and advantages of the systems, devices, and methods of the technology described herein will become more fully apparent from the following description of the implementations illustrated in the figures. These implementations are intended to illustrate the principles of this disclosure, and this disclosure should not be limited to merely the illustrated examples. The features of the illustrated implementations can be modified, combined, removed, and/or substituted as will be apparent to those of ordinary skill in the art upon consideration of the principles disclosed herein.

Safety Container

Figure 1:
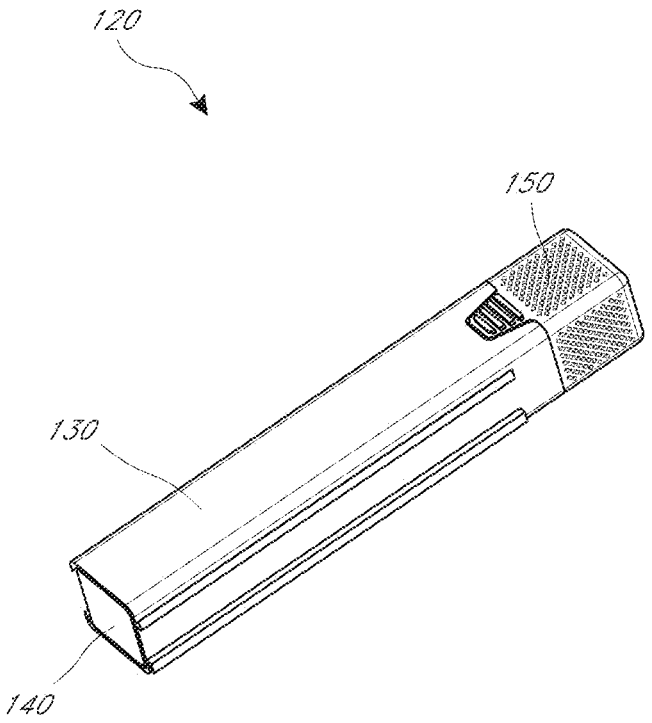
FIG. 1 is a perspective view of a safety container in an assembled configuration.
Figure 2:
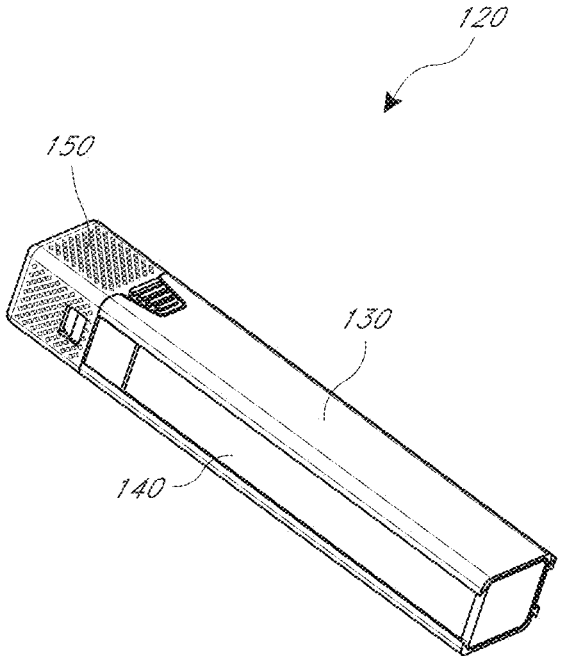
FIG. 2 shows a rear perspective view of the safety container of FIG. 1.

FIGS. 1-2 illustrates a safety container 120. The safety container 120 can include a sleeve 130, a slide 140, and/or a cap 150. In other implementations, the safety container 120 can include further elements and features. The cap 150 can coupled with the sleeve 130 to enclose an interior storage space of the sleeve 130. The slide 140 can interact with the sleeve 130 and/or the cap 150 to form a safety access feature and/or a tamper evident feature.

Figure 3:
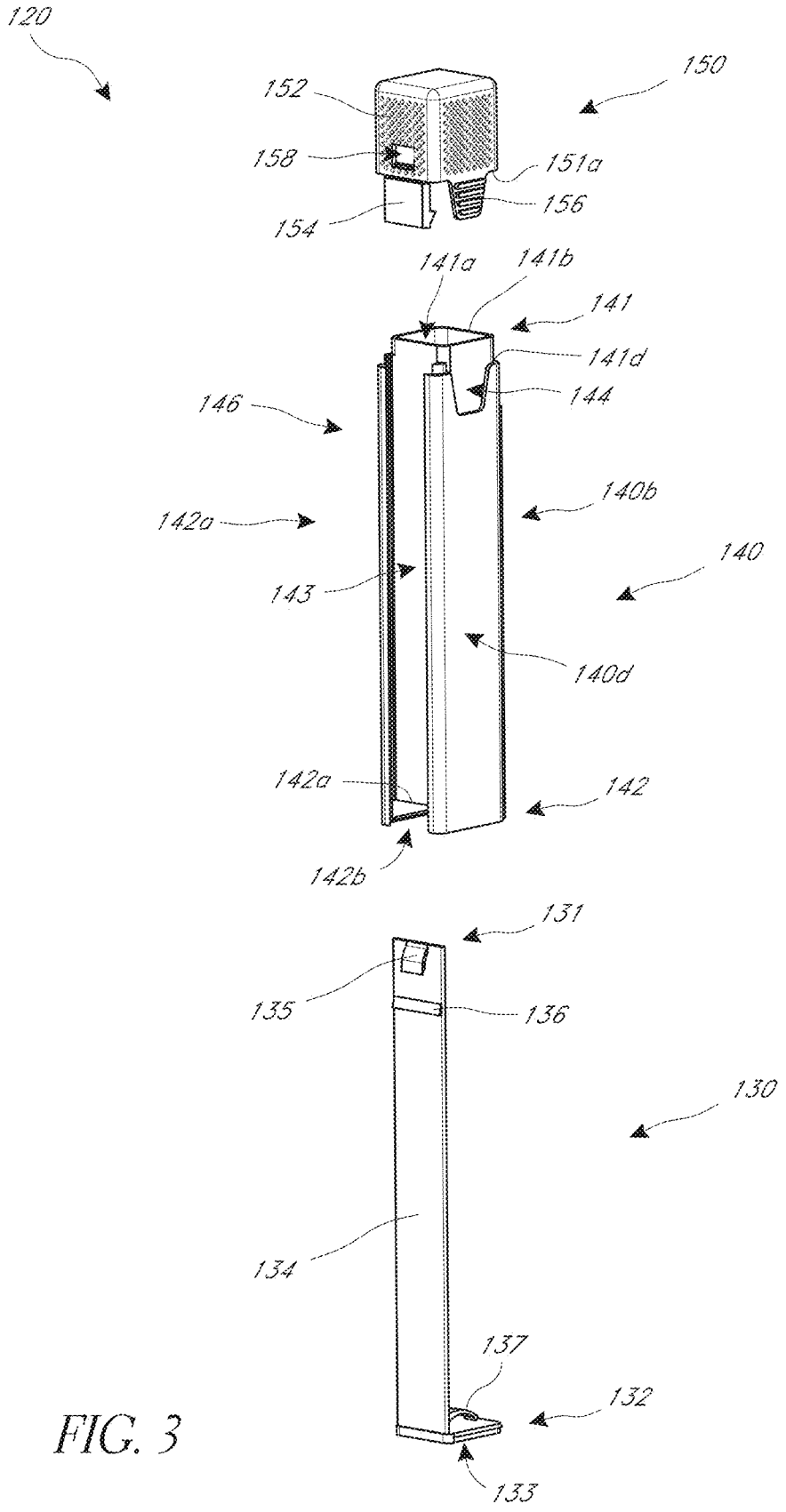
FIG. 3 is an exploded view of the safety container of FIG. 1.
Figure 4A:
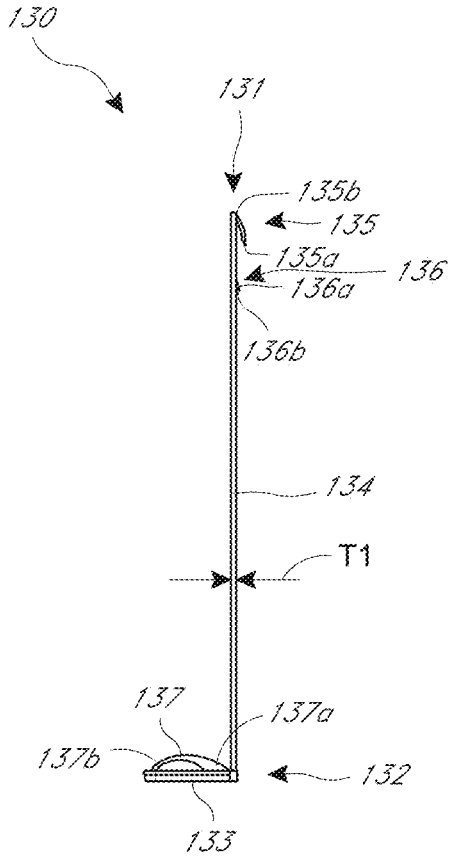
FIG. 4A is a side elevation view of a slide.
Figure 4B:
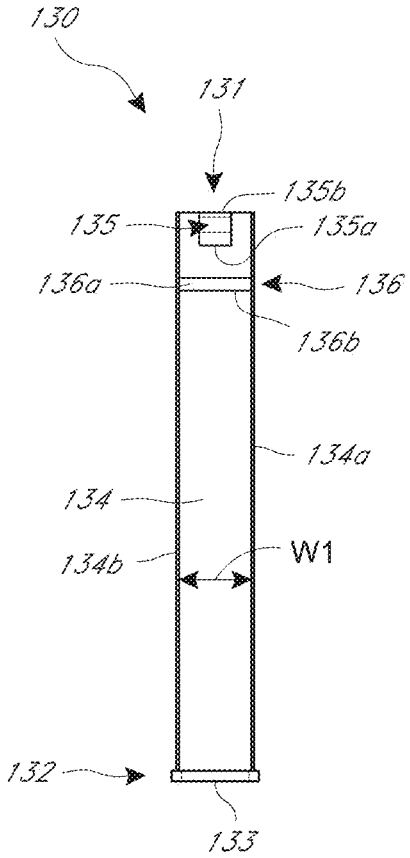
FIG. 4B is a front elevation view of the slide.

FIGS. 3-4B show further detail of the slide 130. The slide 130 can be formed of a polymer, or other material. The slide 130 can be formed of a single, unitary material. The slide 130 can be injection molded. The slide 130 can include a channel leg 134. The channel leg 134 can be a generally flat member. The channel leg 134 can have a rectangular cross section. The rectangular cross section can extend from an upper end 131 of the slide 130 to a lower end 132 of the slide 130.

The channel leg 134 can include first and second sides 134*a*, 134*b*. The first and second sides 134*a*, 134*b* can be parallel and spaced apart a width W1. The width W1 can be between 0.25 inches and 1.5 inches, although this is not required. The channel leg 134 can have a thickness T1. The thickness T1 can be uniform generally from the lower end 132 to the upper end 131. The thickness T1 can be between 0.03 inches and 0.125 inches, although this is not required.

The channel leg 134 can include an spring member 135. The spring member 134 can be on the upper end 131 of the slide 130. The spring member 135 can be a cantilevered extension of the upper end 131. The spring member 135 can be coupled at a base 135*b* with the channel member 134. The spring member 135 can extend outwardly from the channel leg 134 to a distal end 135*a*. The distal end 135*a* can be biased outwardly away from a surface of the channel leg 134. The distal end 135*a* can include a flanged portion on the end thereof. The spring member 135 can be actuatable (e.g., depressed) towards the channel leg 134. The spring member 135 can be biased outwardly from the channel leg 134. The spring member 135 can be formed integrally with the material of the channel leg 134 or attached thereto.

The channel leg 134 can include a ridge 136. The ridge 136 can extend transversely from the channel leg 134. The ridge 136 can be located between the upper and lower ends 131, 132 of the slide 130. The ridge 136 can be located below the spring member 135. The ridge 136 can include an tapered surface 136*a*. The tapered surface can slop outwardly from the channel leg 134. The ridge 136 can include a shelf 136*b*. The shelf 136*b* can extend transversely and outwardly from the channel leg 134. The shelf 136*b* can be formed above or below the tapered surface 136*a*. The tapered surface 136*a* can be located above the tapered surface 136*b*. In another implementation, the tapered surface 136*a* can be located below the shelf 136*b*.

The channel leg 134 can be connected with a bottom leg 133. The bottom leg 133 can be a generally planar portion. Bottom leg 133 can attach with the channel leg 134 at a right angle. The bottom leg 133 can have a generally rectangular profile, when viewed from a bottom elevation view.

The bottom leg 133 can include a spring 137. The spring 137 can be formed as an integral component of bottom leg 133 or assembled therewith. The spring 137 can extend from an upper face of the bottom leg 133. The spring 137 can generally form an arch shape. A base end 137*a* of the spring 137 can attach with the upper face of the bottom leg 133. The spring 137 can be a cantilevered member. A distal tip 137*b* be can be slidingly engaged with the upper face of the bottom leg 133. The spring 137 can taper from the base end 137*a* to the distal tip 137*b*. In another implementation, the spring 137 can be a metal spring. The metal spring can be assembled with the bottom leg 133.

Figure 5A:
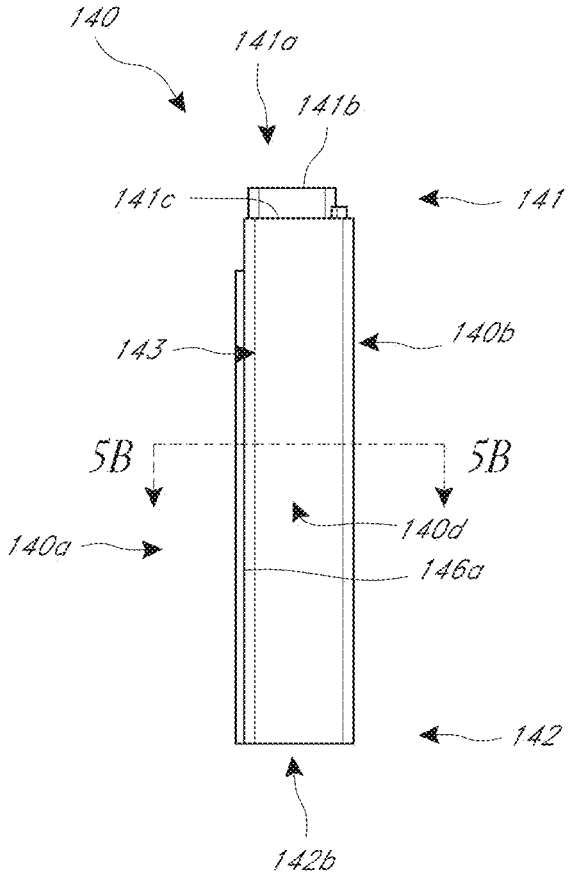
FIG. 5A is a side elevation view of a sleeve.
Figure 5B:
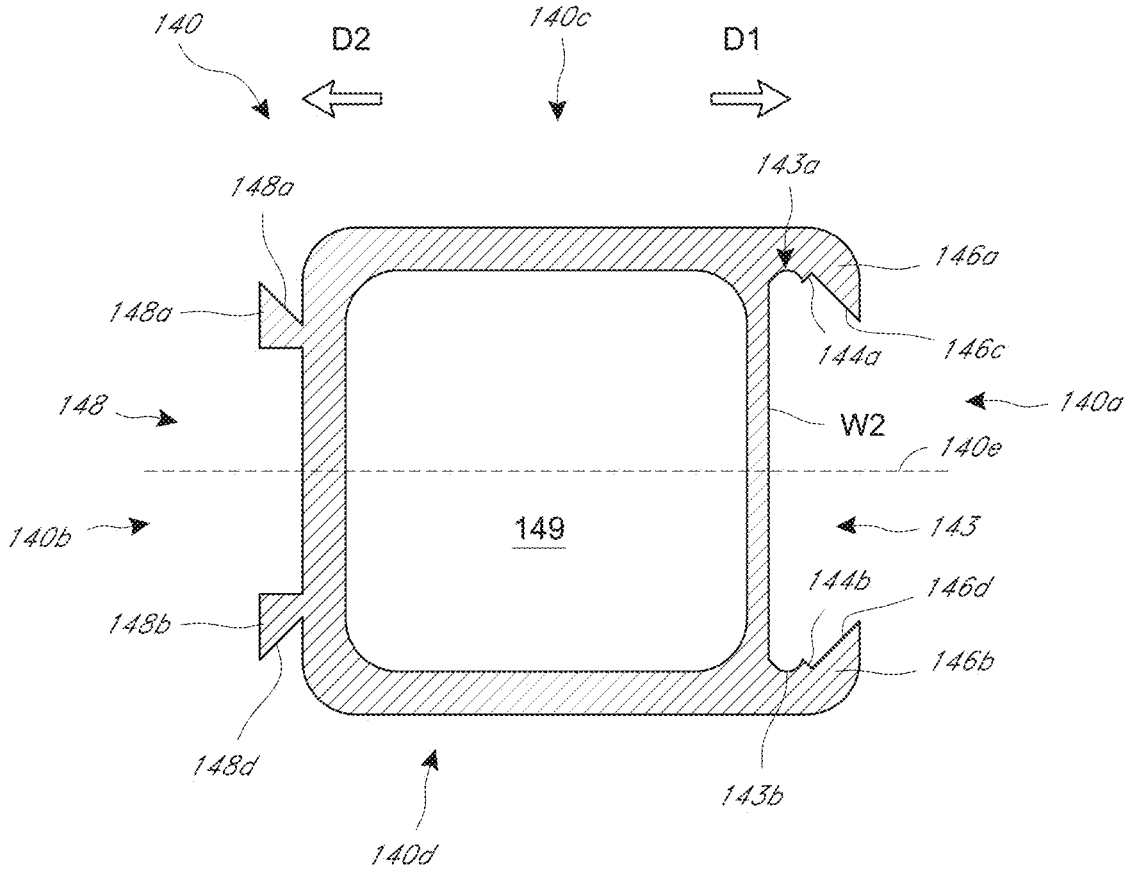
FIG. 5B is a section view taken along the line 5B-5B in FIG. 5A.

FIGS. 3 and 5A-5B show the sleeve 140 in further detail. The sleeve 140 can be a rectangular prism. The sleeve 140 can include four generally planar outer walls 140*a*-*d*. The outer walls 140*a*-*d* can form a rectangular or square cross-sectional shape (as shown in FIG. 5B). The cross-sectional shape can be generally uniform from an upper end 141 to a lower end 142. In other implementations, the sleeve 140 can have a different cross-sectional shape, such as, but not limited to circular, polygonal, curved or other. In other implementations, the cross-sectional shape can be non-uniform between the upper end 141 and the lower end 142.

The upper end 141 can include an opening 141*a*. The opening 141*a* can be defined by an upper lip 141*b*. The upper lip 141*b* can extend around the opening 141*a*. The upper lip 141*b* can be a surface within a single plane. The opening 141*a*/upper lip 141*b* can be shaped liked the cross-sectional shape of the sleeve 140. In other implementations, the upper lip 141*b* can extend across one or more planes.

The sleeve 140 can include a recessed outer periphery on the upper end 141. The recessed outer periphery can include a shelf 141*c*. The shelf 141*c* can extend around the sleeve 140. The shelf 141*c* can be angled relative to the sleeve 140. The angle can be between 0 and 180 degrees. In one implementation, the angle can be perpendicular. The outer periphery can include an alignment notch 144. The alignment notch 144 can be formed by a portion of the shelf 141*c*. The alignment notch 144 can be offset (e.g., downward) from adjacent portions of the shelf 141*c*.

The opening 141*a* can lead into an interior space 149. The interior space 149 is used to store one or more articles. The interior space 149 can extend from the opening 141*a* at the upper end 141 to a lower panel 142*a* at the lower end 142. An interior cross-sectional shape of the interior space 149 can be the same or different than the outer cross-sectional shape of the sleeve 140. The interior cross-sectional shape can be uniform or different from the upper end 141 to the lower end 142.

A first side 140*a* of the sleeve 140 can include a slide channel 143. The slide channel 143 can extend from the upper end 141 to the lower end 142 along the first side 140*a*. The slide channel 143 can include a concave groove 143*a* and/or second groove 143*b*. The concave grooves 143*a*, 143*b* can be disposed along opposite ends of the first side 140*a*. The concave grooves 143*a*, 143*b* can extend from the upper end 141 to the lower end 142, or a shorter length therebetween. The concave grooves 143*a*, 143*b* can face each other. The concave grooves 143*a*, 143*b* can be spaced apart a width W2. The width W2 can be greater than the width W1 of the channel leg 134. The slide channel 143 can be open to an exterior of the sleeve 140. Alternatively, the slide channel 143 can be partially or fully enclosed by a wall.

The lower end 142 of the sleeve 140 can include the lower panel 142*a*. The lower panel 142*a* can enclose the interior space 149 at the lower end 142.

The lower end 142 can include a bottom recess 142*b*. The bottom recess 142*b* can be open on a bottom end thereof. The bottom recess 142*b* can be enclosed around the top and sides thereof. The bottom recess 142*b* can be at least partially defined by the lower panel 142*a* and/or one or more of the walls 140*a*-*d* of the sleeve 140.

The sleeve 140 can include a slide-connection system. The slide-connection system can be included on one or more of the outer walls 140*a*-*d*. The slide-connection system can include male and female slide locks. The male and female slide locks can be on opposite sides of the sleeve 140. Alternatively, the male and female slide locks can be on adjacent sides.

The first side 140*a* can include a female slide lock 146. The female slide lock 146 can slidingly engage with a male slide lock of another similar safety container. The female slide lock 146 can extend along the first side 140*a*. The female slide lock can extend from the upper end 141 to the lower end 142. The female slide lock 146 can also extend along a portion between the upper or lower ends 141, 142.

The female slide lock 146 can include a first spaced flange 146*a* and a second spaced flange 146*b*. The spaced flanges 146*a*, 146*b* can face each other along the first side 140*a*. The first and second spaced flanges 146*a*, 146*b* can be aligned on opposite sides of the first side 140*a*. Each of the spaced flanges 146*a*, 146*b* can include an inwardly sloped face 146*c*, 146*d*, respectively. The inwardly sloped faces 146*c*, 146*d* can narrow (e.g., towards a centerline 140*e* of the sleeve 140) from an interior position moving outwardly to an exterior position of the side 140*a* (e.g., direction D1). Thus, at the outer most portion of the spaced flanges 146*a*, 146*b*, the inwardly sloped faces 146*c*, 146*d* are at their narrowest point.

The sleeve 140 can include a second side 140*b*. The second slide 140*b* can include a male slide lock 148. The second side 140*b* can be opposite the first side 140*a*. Alternatively, the second side 140*b* can be adjacent to the first side 140*a*. The male slide lock 148 can extend along the second side 140*b*. The male slide lock 148 can extend from the upper end 141 to the lower end 142. The male slide lock 148 can extend along a portion of the second side 140*b* between the upper and lower ends 141, 142.

The male slide lock 148 can include first and second spaced flanges 148*a*, 148*b*. The first and second spaced flanges 148*a*, 148*b* can be spaced on opposite ends of the second side 140*b* of the sleeve 140. The spaced flanges 148*a*, 148*b* can include outwardly sloped faces 148*c*, 148*d*, respectively. The outwardly sloped faces 148*c*, 148*d*, can be on outer faces of the spaced flanges 148*a*, 148*b*. The outwardly sloped faces 148*c*, 148*d*, can slope outwardly (e.g., away from the centerline 140*e*) as the spaced flanges extend outwardly away from the second side 140*b* of the sleeve 140 (e.g., direction D2). The outwardly sloped faces 148*c*, 148*d* of the male slide lock 148 can be angled to slidingly engage with a female slide lock of another safety container.

The slide channel 143 can be aligned with the female slide lock 146. The slide channel 143 can be open to the female slide lock 146. The first and second spaced flanges 146*a*, 146*b* can be on or aligned along the concave grooves 143*a*, 143*b*, respectively. In another implementation, an exterior wall of the sleeve 140 can be between the slide channel 143 and the female slide lock 146. In another implementation, the slide channel 143 can be aligned with the male slide lock 148.

The inwardly sloped faces 146*c*, 146*d* can be planar. In one implementation, the inwardly sloped faces 146*c*, 146*d* can be curved, grooved, flanged (e.g., L-shaped), or otherwise. The outwardly sloped faces 148*c*, 148*d* can be planar. In one implementation, the outwardly sloped faces 148*c*, 148*d* can be curved, grooved, flanged, or otherwise. The outwardly sloped faces 148*c*, 148*d* can be correspondingly shaped with the inwardly sloped faces 146*c*, 146*d* to be engaged therewith when included on another container unit in a linked set.

Figure 6B:
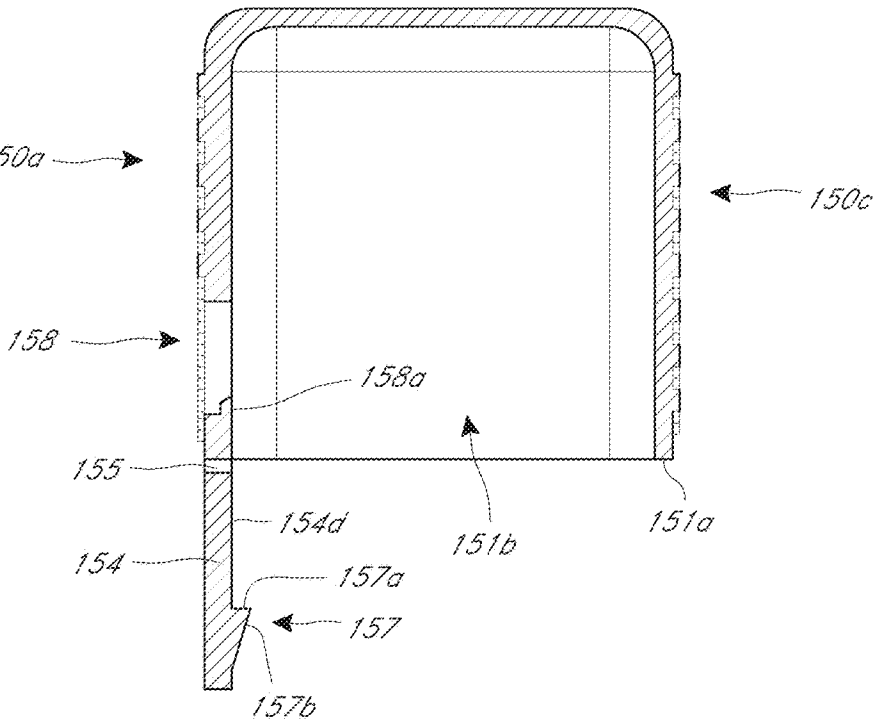
FIG. 6B is a section view taken along the line 6B-6B in FIG. 6A.
Figure 6A:
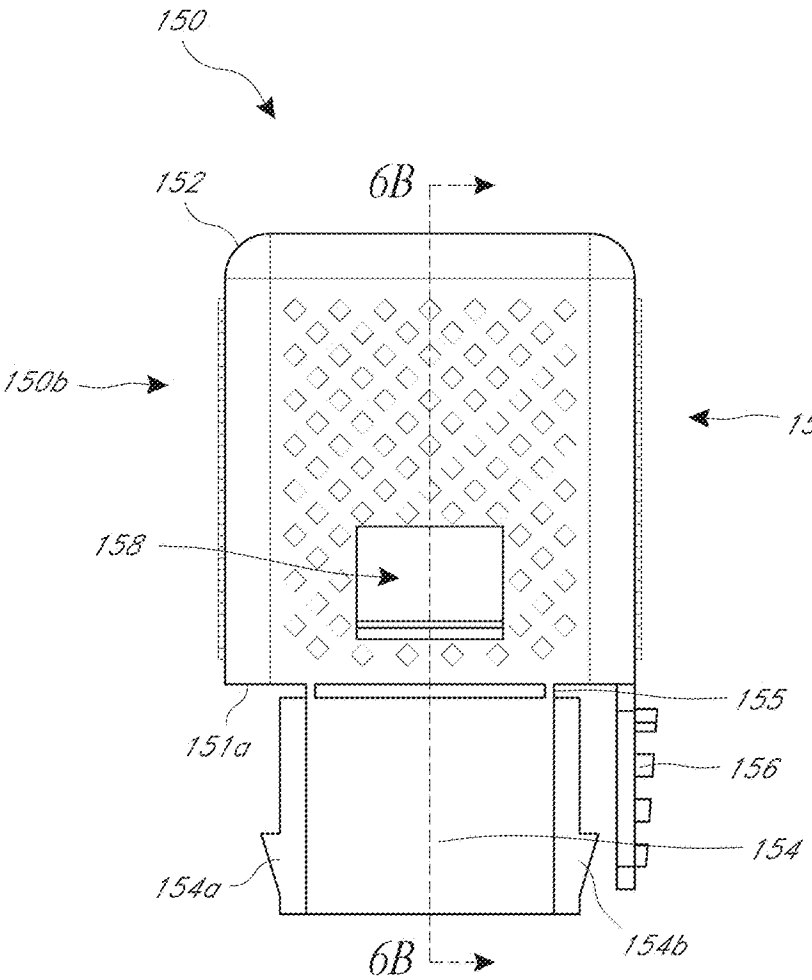
FIG. 6A is a front elevation view of a cap.

FIGS. 3 and 6A-6B further show the cap 150. The cap 150 can generally be a rectangular prism. The cap 150 can include sides 150*a-d*. The sides 150*a-d* can correspond to the sides 140*a-d* of the sleeve 140. In another implementation, the cap 150 can include fewer or more sides, or other cross-sectional profile shape (e.g., circular, etc.). The cap 150 can include a top surface 150*e*. The top surface 150*e* can enclose one end of the sides 150*a-d*.

The cap 150 can include an outer surface 152. The outer surface 152 can comprise one or more grip enhancement features for aiding a user in grasping the cap 150. The grip enhancement features can be indentations, projections, or other surface features. The grip enhancement features can be on any or all of the sides 150*a-d*.

The cap 150 can include a lower lip 151*a*. The lower lip 151*a* can extend around an opening 151*b* of the cap 150. The lower lip 151*a* can be in a single plane. The lower lip 151*a*/opening 151*b* can have a cross sectional profile that matches the cross-sectional profile of the upper end 141 of the sleeve 140.

The cap 150 can include a lock tab 154. Lock tab 154 can be on a first side 150*a* of the cap 150. The lock tab 154 can be coupled with the cap 150. The lock tab 154 can be coupled with the cap 150 at the lower lip 151*a*. The lock tab 154 can extend downwardly from the lower lip 151*a*. The lock tab 154 can be aligned with the first side 150*a*.

The lock tab 154 can be integrally formed with the cap 150. The lock tab 154 can be coupled with the lower lip 151*a* by a frangible region 155. The frangible region 155 can include one or more thin regions of the material of the cap 150. The thin regions can link the lower lip 151*a* with the lock tab 154. The frangible region 155 can be broken by a user to remove the lock tab 154 from the lower lip 151*a*.

The lock tab 154 can include outwardly sloped faces 154*a*, 154*b*. The outwardly sloped faces 154*a*, 154*b* can be aligned along opposite sides of the locked tab 154. The outwardly sloped faces 154*a*, 154*b* can taper outwardly from an outer side 154*c* of the lock tab 154. The outwardly sloped faces 154*a*, 154*b* can be sized to fit within an upper end of the female slide lock 146 of the sleeve 140. One or both of the sloped faces 154*a*, 154*b* are optional.

The locked tab can include a protrusion 157. The protrusion 157 can extend transversely from an inner side 154*d* of the locked tab 157. The inner side 154*d* can face the opening 151*b* of the cap 150. The protrusion 157 can include a shelf 157*a*. The protrusion 157 can include tapered portion 157*b*. The tapered portion 157*b* be a sloped face on the inner side 154*d* to the shelf 157*a*. The tapered portion 157*b* can be below the shelf 157*a*. In another implementation, the tapered portion 157*b* can be above the shelf 157*a* (e.g., when the tapered portion 136*a* is below the shelf 136*b*).

The cap 150 can include a lock aperture 158. The lock aperture 158 can be aligned on the same side as the lock tab 154. The lock aperture 158 can be on the first side 150*a*. The lock aperture 158 can extend through the first side 150*a* of the cap 150 into an interior space therein. The lock aperture 158 can be centered over the lock tab 154 on the side 150*a*. The lock aperture 158 can include an inner flange 158*a*. The inner flange 158*a* can extend along an edge of the lock aperture 158. The inner flange 158*a* can be on an innermost side of the edge (e.g., closest to the interior space). The inner flange 158*a* can include a chamfered end. The inner flange 158*a* can extend along a bottom edge of the lock aperture 158. In other implementations, the inner flange 158*a* can extend along a side edge of the block aperture 158.

The cap 150 can include an alignment tab 156. The alignment tab 156 can couple with the lower lip 151*a*. The alignment tab 156 can be on a second side 150*d* of the cap 150. The second side 150*d* can be adjacent the first side 150. In another embodiment, the second side 150*d* can be opposite the first side 150*a*. The alignment tab 156 can extend downwardly from the lower lip 151*a*. The alignment tab 156 can include a grip enhancement feature. The alignment tab 156 can be sized to be received within the alignment notch 144 at the upper end 141 of the sleeve 140. The alignment tab 156 can assist in aligning the cap 150 with the upper end of the sleeve 140 (e.g., engaging within the alignment aperture 144).

Figure 7B:
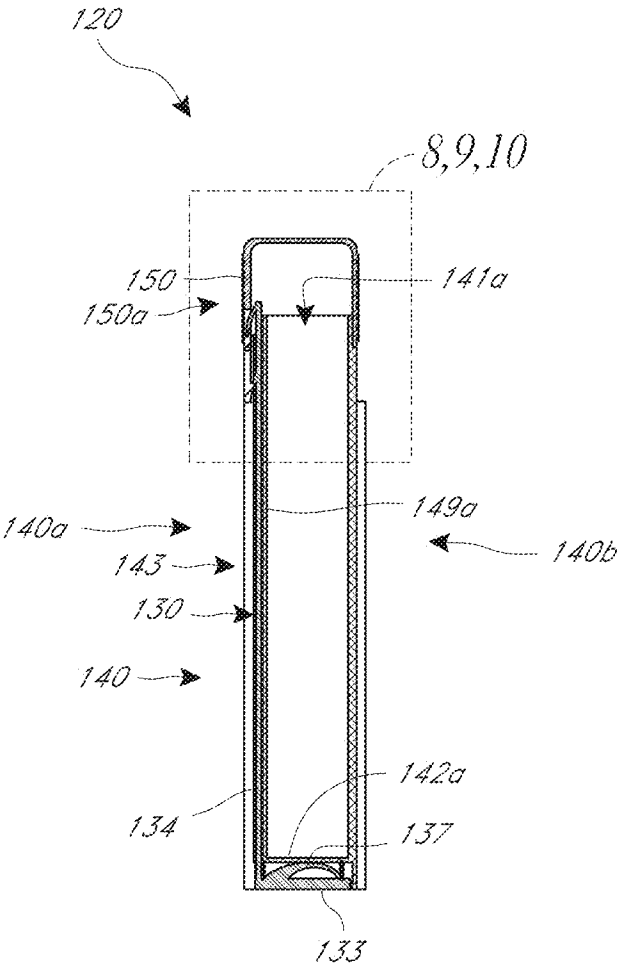
FIG. 7B is a section view taken along the line 7B-7B in FIG. 7A.
Figure 7A:
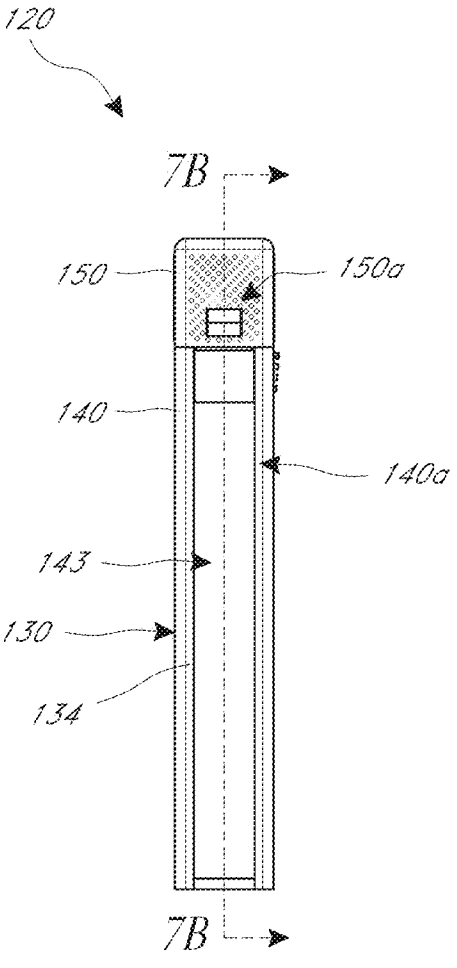
FIG. 7A is a front elevation view of the safety container of FIG. 1.
Figure 8:
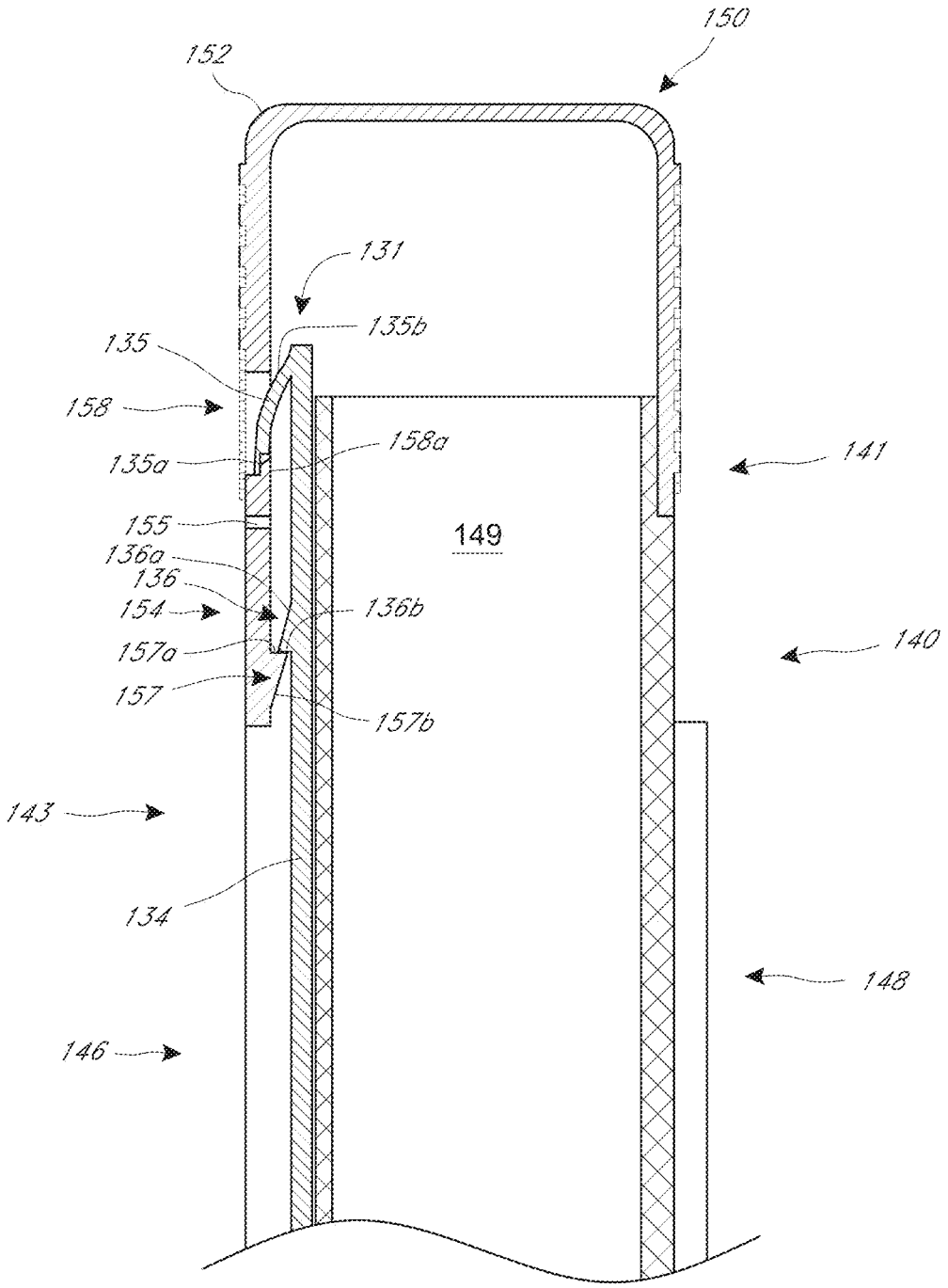
FIG. 8 is a detail view of FIG. 7B in the assembled configuration.

FIGS. 7A-8 illustrate the safety container 120 in an assembled configuration. In the assembled configuration the channel leg 134 of the slide 130 is inserted into the slide channel 143. The upper end 131 of the slide 130 can be inserted into slide channel 143 at the lower end 142 of the sleeve 140. The first and second sides 134*a*, 134*b* of the channel leg 134 can fit between the grooves 143*a*, 143*b* of the slide channel 143. The channel leg 134 can be slidable within the slide channel 143.

The upper end 131 of the slide 130 can be generally aligned with the upper end 141 of the sleeve 140. The lower end 132 of the slide 130 can be generally aligned with the lower end 142 of the sleeve 140. The bottom leg 133 can be received within the bottom recess 142*b*. The spring 137 can contact the lower panel 142*a* of the sleeve 140. The spring 137 can bias the bottom leg 133 away from the bottom panel 142*a* of the sleeve 140. The bottom leg 133 can be pressed closer to the lower panel 142*a* by compressing the spring 137. Compressing the spring 137 by application of force against the bottom leg 133 moves the channel leg 134 upwards within the slide channel 143.

The cap 150 can be assembled with the upper end 141 of the sleeve 140 to enclose the interior space 149. The opening 151*b* can receive the recessed outer periphery of the upper end 141. The opening 151*b* can receive the upper lip 141*b*. The lower lip 150*a* can fit over the recessed outer periphery of the upper end 141. The lower lip 141*b* can abut the shelf 141*c*. The lower lip 141*b* can abut the shelf 141*c* around the outer periphery of the upper end 141. The alignment tab 156 can received within the alignment notch 144. The alignment tab 156 can align the cap 150 with the sleeve 140.

The lock tab 154 can be aligned with the first side 140*a* of the sleeve 140. The lock tab 154 can be aligned with the female slide lock 146. The lock tab 154 can be received at least partially within an upper end of the female slide lock 146. The lock tab 154 can be engaged between the spaced flanges 146*a*, 146*b*. The outwardly sloped faces 154*a*, 154*b* can engage with the respective inwardly sloped faces 146*c*, 146*d* of the female slide lock 146. The engagement between the inwardly sloped faces 146*c*, 146*d* and the outwardly sloped faces 154*a*, 154*b* can be sliding engagement. The lock tab 154 can be securely retained within the female slide lock 146 by the interaction of the inwardly sloped faces 146*c*, 146*d* with the outwardly sloped faces 154*a*, 154*b*. The lock tab 154 and/or cap 150 can block an upper end of the female slide lock 146.

The cap 150 can engage with the upper end 131 of the slide 130. The ridge 136 can engage with the protrusion 157 of the lock tab 154. To assemble, the tapered portion 157*b* can slide over the tapered portion 136*a*. The sliding engagement of the tapered portion 157*b* with the tapered portion 136*a* can flex the channel leg 134 and/or the lock tab 154 or other component of the container 100. Once assembled, the shelf 157*a* can engage with the shelf 136*b*. The engagement of the shelf 157*a* with the shelf 136*b* can lock the cap 150 against removal in an upwards direction. The engagement of the shelf 157*a* with the shelf 136*b* can lock the slide 131 against removal from the slide channel 143 in a downwards direction. The spring 137 acting against the lower panel 142*b* can bias the engagement of the ridge 136 with the protrusion 157.

In another implementation, the orientation of the tapered portion 157*b* and the tapered portion 136*a* can be reversed. The engagement of the shelf 157*a* with the shelf 136*b* can lock the slide 131 allow removal of the cap 150 in an upwards direction and/or removal of the slide channel 143 in a downwards direction. The engagement of the shelf 157*a* with the shelf 136*b* can prevent upwards advancement of the channel leg 134 within the slide channel 143. The cap 150 can be held in place by the spring member 135.

In the assembled configuration, the spring member 135 can engage within the lock aperture 158. The spring member 135 can be generally aligned with the lock aperture 158 with the cap 150 assembled on the sleeve 140. The spring member 135 can be biased to extend outwardly from the outer surface of the channel leg 134. As the channel leg 134 is inserted into the slide channel 143, the spring member 135 can automatically extend to engage within the lock aperture 158.

The distal end 135*a* of the spring member 135 can be received within the lock aperture 158. The distal end 135*a* can contact the bottom edge of the lock aperture 158. The distal end 135*a* can engage with the inner lip 158*a* of the lock aperture 158. The distal end 135*a* can engage with the inner lip 158*a* of the lock aperture 158 on an outerward side thereof. The inner lip 158*a* can prevent actuation (e.g., depression) of the distal end 135*a* inward and/or out of the lock aperture 158.

The engagement of the spring member 135 with the lock aperture 158 can prevent removal of the slide 130 from within the slide channel 143. The spring member 135 with the can prevent removal of the slide 130 from within the slide channel 143 in a downward direction. The engagement of the spring member 135 with the lock aperture 158 can prevent removal of the cap 150 from the upper end 141 of the sleeve 140. The spring member 135 can prevent removal of the cap 150 from the upper end 141 of the sleeve 140 in an upwards direction.

Figure 9:
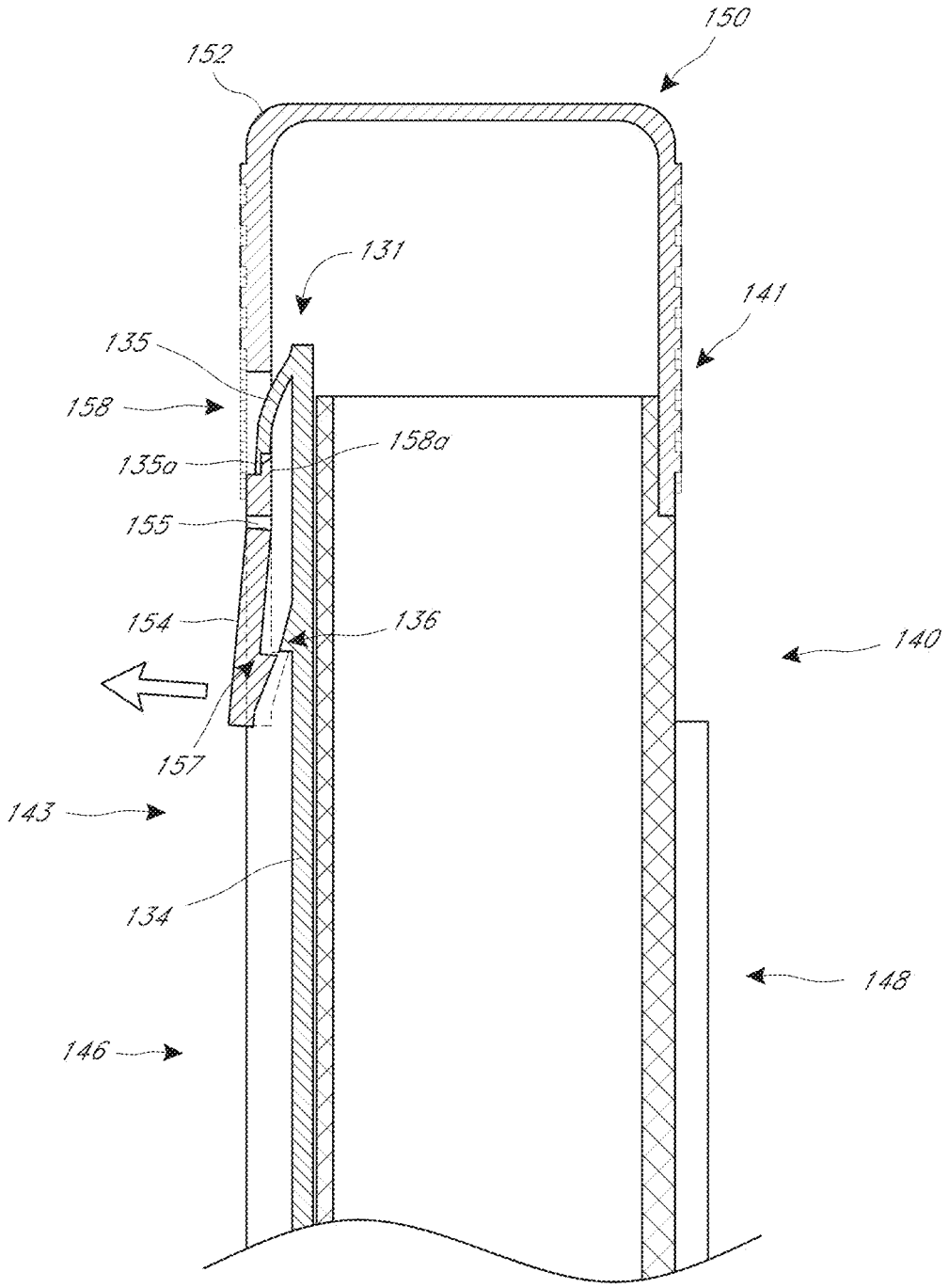
FIG. 9 is the detail view of FIG. 7B showing disassembly of the safety container of FIG. 1.
Figure 10:
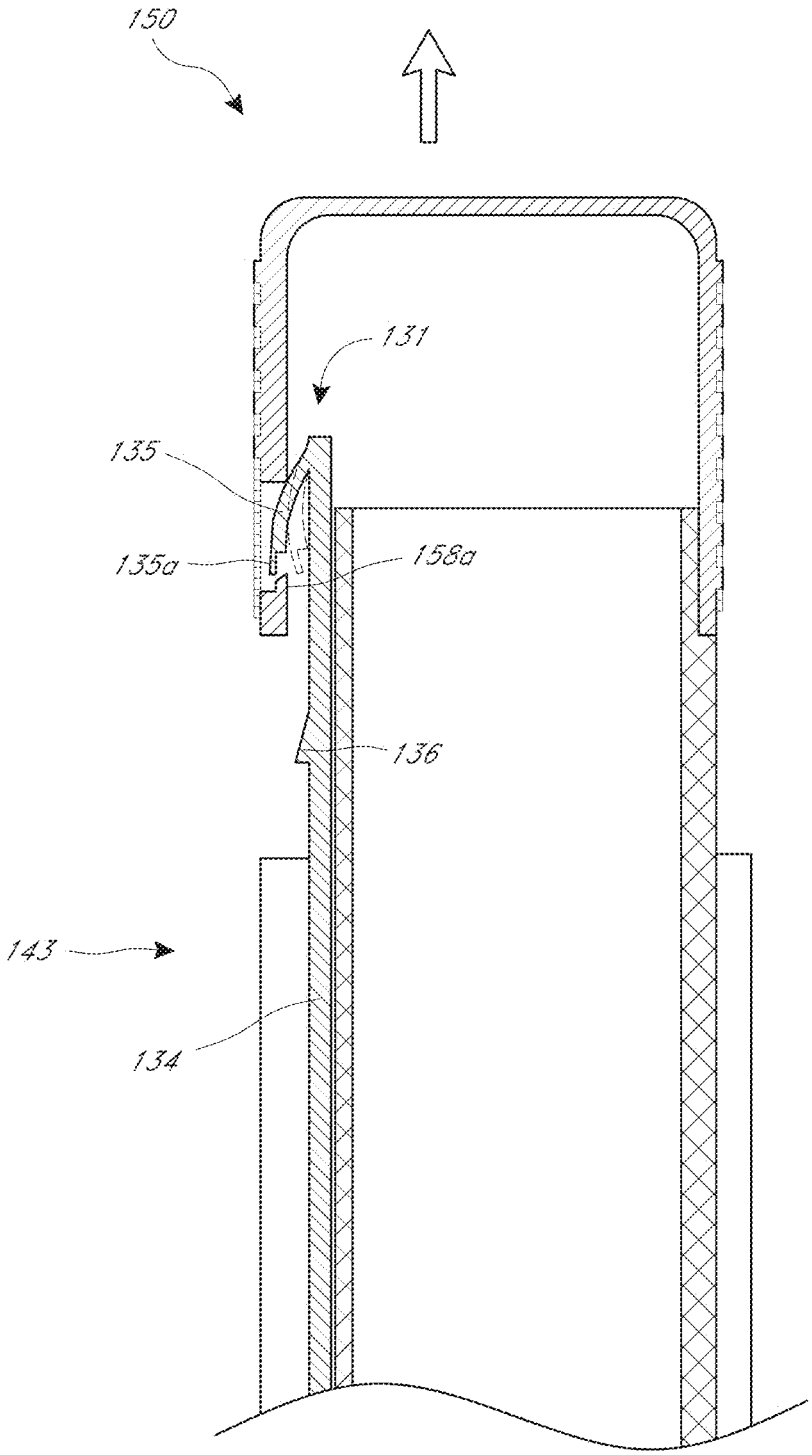
FIG. 10 is the detail view of FIG. 7B showing further disassembly of the safety container of FIG. 1.

FIGS. 9 and 10 illustrate steps in the process of removing the cap 150 from the upper end 141 of the sleeve 140 and/or cap 150. To remove the cap 150 from the upper end 141, a first step can be to disengage or remove the locking tab 154 from the sleeve 140 and/or cap. The locking tab 154 can be moved outwardly from the sleeve 140. The locking tab 154 can be removed by inserting a finger or object underneath the locking tab 154 and moving the locking tab 154 outwardly from the female slide lock 146. The outwardly sloped faces 154*a*, 154*b* and/or the spaced flanges 146*a*, 146*b* can deform (either plastically or elastically) as the locking tab 154 is removed from the female slide lock 146. Deformation of the outwardly sloped faces 154*a*, 154*b* and/or the spaced flanges 146*a*, 146*b* can be a tamper evident feature.

Movement of the lock tab 154 can break it away from the lock cap 150 along the frangible portion 155. The frangible portion 155 can make the lock tab 157 a tamper evident feature. If the frangible portion 155 has been broken and/or the lock tab 154 removed, this communicates to a potential user that the cap 150 has been possibly been opened.

A second step to removing the cap 150 from the upper end 141 can include depressing the spring member 135 through the lock aperture 158. The second step can be done either before, after or simultaneous with the first step. The slide 130 can be advanced upwardly within the slide channel 143. The slide 130 can be advanced upwardly by a force on the bottom leg 133 to depressing the spring 137 against the lower panel 142*b*.

With the upper end 131 of the slide 130 raised relative to the lock aperture, as shown in FIG. 9, the distal end 135*a* of the spring member 135 can be out of alignment or at least partially out of alignment with the inner lip 158*a*. The user can then (e.g., simultaneously with applying the force on the bottom leg 133) depress the spring member 135. The spring member 135 can be depressed through the lock aperture 158. With the distal end 135*a* of the spring member 135 misaligned from the lock aperture 158, the cap 150 can be removed from the top 141 of the sleeve 140. With the cap 150 removed, the contents of the interior space 149 can be accessed.

The slide lock 130 and its engagement with the sleeve 140 and the cap 150 can thus constitute an access safety mechanism. The access safety mechanism can require multiple steps and/or a series of steps or simultaneous steps to remove the cap 150 and access the contents within the interior space 149.

Linked Set

Figure 11:
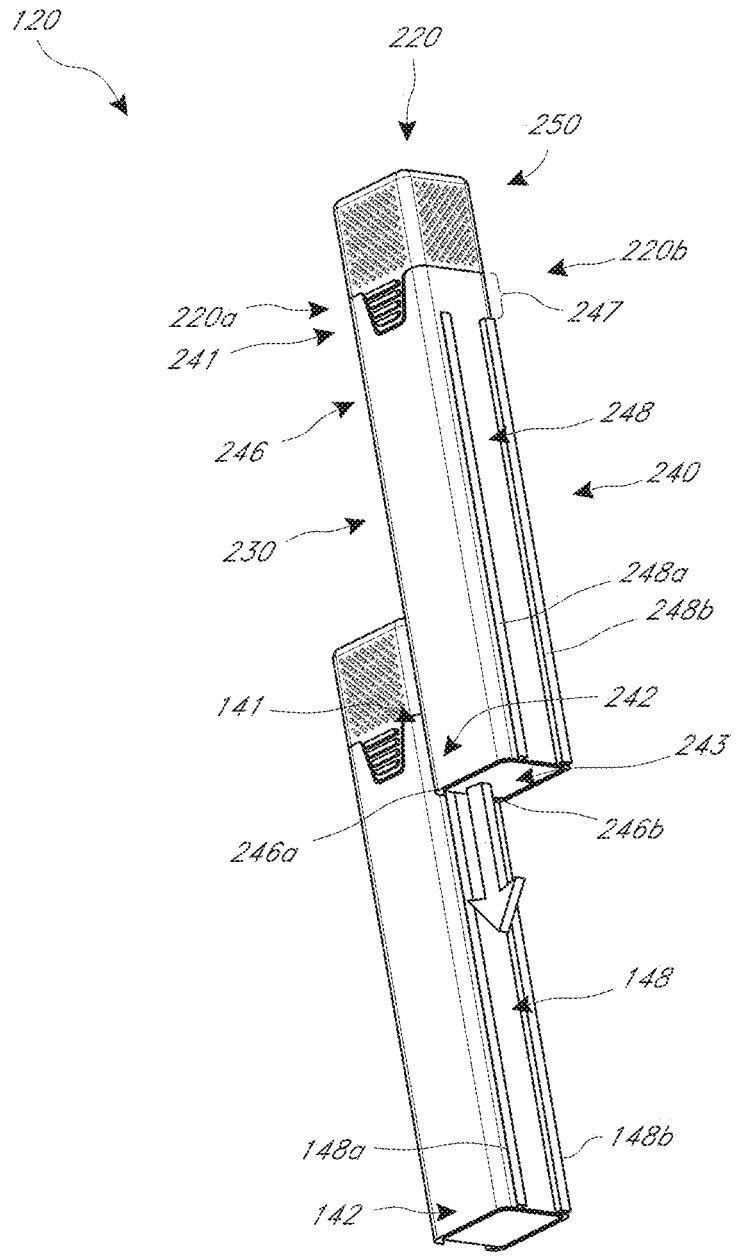
FIG. 11 is a perspective view of a linked set of two container units.

The safety container 120 can be configured to be connected with one or more other similar safety containers to form a linked set of container units. FIG. 11 illustrates a second safety container 220. The safety container 220 can be identical in every or various aspects with the safety container 120 (e.g., a slide 230, sleeve 240, and/or cap 250). The safety container 220 can include a first side 220*a* and a second side 220*b*. The first and second sides 220*a*, 220*b* can be on opposite sides of the second safety container 220. The first sides 220*a* can include a female slide lock 246. The female slide lock 246 can include a first spaced flange 246*a* and a second space flange 246*b*. The first and second space flanges 246*a*, 246*b* can be similar to the first and second space flanges 146*a*, 146*b*. The first and second space flanges 246*a*, 246*b* can include inwardly tapered surfaces 246*c*, 246*d* (not shown), similar to the inwardly tapered surfaces 146*c*, 146*d* of the female slide lock 146 of the safety container 120.

The second safety container 220 can include a male slide lock 248 on the second side 220*b*. The male slide lock 248 can include first and second spaced flanges 248*a*, 248*b*, similar to the first and second spaced flange 148*a*, 148*b* of the male slide lock 148. The first and second spaced flanges 248*a*, 248*b* can include outwardly tapered surfaces 148*c*, 148*d* similar to the outwardly tapered surfaces 248*c*, 248*d* (not shown) of the male slide lock 148.

The two safety containers 120, 220, can be removably coupled together by engagement of corresponding male and female slide locks. The female slide lock 246 can align with the male slide lock 148. A bottom end 242 of the female slide lock 246 can align with the upper end 141 of the sleeve 140 and the male slide lock 148. A top end of the female slide lock 246 can be blocked by a lock tab. The spaced flanges 148*a*, 148*b* can be slid between the spaced flanges 246*a*, 246*b* to lock the slide locks 148, 246. The outwardly tapered surfaces 148*c*, 148*d* can be aligned and slidingly engaged with the inwardly tapered surfaces 246*c*, 246*d*. The upper end 141 can then be aligned with the upper end 241 (e.g., caps and/or sleeve can be generally aligned).

The male slide lock 148 can contact the cap of the second safety container 220 (e.g., the end of the female slide lock 246). The male slide lock 148 can be offset a distance 147 from an upper end of the sleeve 240. The offset 147 can be sized to accommodate a lock tab of the cap 250 within the female slide lock 246.

In another implementation, the female slide lock 146 can align with the male slide lock 248. A bottom end 242 of the female slide lock 146 can align with the upper end 141 of the sleeve 140 and the male slide lock 248. A top end of the female slide lock 146 can be blocked by the lock tab 154. The spaced flanges 248*a*, 248*b* can be slid between the spaced flanges 146*a*, 146*b* to lock the slide locks 248, 146. The outwardly tapered surfaces 248*c*, 248*d* can be aligned and slidingly engaged with the inwardly tapered surfaces 146*c*, 146*d*. The upper end 141 can then be aligned with the upper end 241 (e.g., caps and/or sleeve can be generally aligned).

Figure 12:
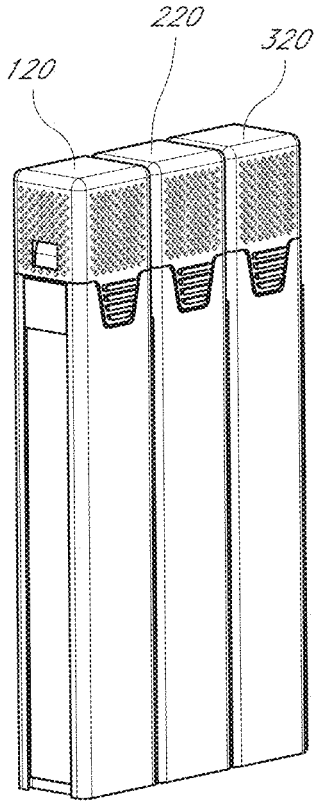
FIG. 12 is a perspective view of a link set of three container units.

In some implementations, the same engagement between corresponding male and female slide locks can be repeated with other safety containers having corresponding male and female slide locks to form the linked set. The linked set can include any number of safety containers units. As shown in FIG. 12, a third safety container 320 is attached on an opposite side of the second safety container 220 from the safety container 120.

An adjacent container unit of the linked set can block access to one or more of the container units. For example, the male slide lock 148 of the safety container 120 coupled with the female slide lock 246 of the safety container 220 can block access to the lock tab and/or lock aperture of the cap 250. This provides the advantage of an extra layer of security for the linked set. A person would have to at least partially disassembly the linked set (e.g., at least safety container 120) to access the contents of the safety container 220.

Certain Terminology

Terms of orientation used herein, such as "top," "bottom," "proximal," "distal," "longitudinal," "lateral," and "end," are used in the context of the illustrated implementation. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain implementations include or do not include, certain features, elements, and/or steps. Thus, such conditional language is not generally intended to imply that features, elements, and/or steps are in any way required for one or more implementations.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain implementations require the presence of at least one of X, at least one of Y, and at least one of Z.

The terms "approximately," "about," and "substantially" as used herein represent an amount close to the stated amount that still performs a desired function or achieves a desired result. For example, in some implementations, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain implementations, as the context may dictate, the term "generally parallel" can refer to something that departs from exactly parallel by less than or equal to 20 degrees. All ranges are inclusive of endpoints.

Summary

Several illustrative implementations of containers have been disclosed. Although this disclosure has been described in terms of certain illustrative implementations and uses, other implementations and other uses, including implementations and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various implementations. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one implementation or example in this disclosure can be combined or used with (or instead of) any other portion of any of the steps, processes, structures, and/or devices disclosed or illustrated in a different implementation, flowchart, or example. The implementations and examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative implementations have been described, any implementations having equivalent elements, modifications, omissions, and/or combinations are also within the scope of this disclosure. Moreover, although certain aspects, advantages, and novel features are described herein, not necessarily all such advantages may be achieved in accordance with any particular implementation. For example, some implementations within the scope of this disclosure achieve one advantage, or a group of advantages, as taught herein without necessarily achieving other advantages taught or suggested herein. Further, some implementations may achieve different advantages than those taught or suggested herein.

Some implementations have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various implementations can be used in all other implementations set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular implementation of the inventions disclosed herein. No aspects of this disclosure are essential or indispensable. In many implementations, the devices, systems, and methods may be configured differently than illustrated in the figures or description herein. For example, various functionalities provided by the illustrated modules can be combined, rearranged, added, or deleted. In some implementations, additional or different processors or modules may perform some or all of the functionalities described with reference to the example implementation described and illustrated in the figures. Many implementation variations are possible. Any of the features, structures, steps, or processes disclosed in this specification can be included in any implementation.

In summary, various implementations and examples of containers and related methods have been disclosed. This disclosure extends beyond the specifically disclosed implementations and examples to other alternative implementations and/or other uses of the implementations, as well as to certain modifications and equivalents thereof. Moreover, this disclosure expressly contemplates that various features and aspects of the disclosed implementations can be combined with, or substituted for, one another. Accordingly, the scope of this disclosure should not be limited by the particular disclosed implementations described above, but should be determined only by a fair reading of the claims.

What is claimed is:

1. A connectable safety container comprising:

a cap comprising:

an outer grip portion including a lower lip;

a lock tab extending downwardly from the lower lip, the lock tab including an inner protrusion, the lock tab attached with the lower lip by a frangible portion;

an alignment tab extending downwardly from the lower lip; and a lock aperture extending through a first side of the outer grip portion, an inner lip disposed within the lock aperture;

a sleeve comprising:

an interior space for containing an article;

an upper opening into the interior space;

an alignment notch;
a lower panel;
a bottom recess below the lower panel;
a slide channel disposed along a first side of the sleeve;
a male slide lock disposed along a second side of the sleeve, opposite the first side, the male slide lock including a pair of spaced flanges, each of the spaced flanges having an outwardly sloped face; and
a female slide lock disposed on the first side of the sleeve and including a pair of spaced flanges, each of the spaced flanges having an inwardly sloped face;
a slide comprising:
an upper end and a lower end;
a bottom leg on the lower end including a spring;
a channel leg coupled to the bottom leg, the channel leg including a lower ridge and an upper spring member on the upper end;
wherein in an assembled configuration:
the channel leg is disposed within the slide channel, the bottom leg is disposed within the bottom recess, and the spring engages with the lower panel;
the lower lip of the cap is fit over the upper opening of the sleeve to enclose the interior space, the alignment tab is disposed within the alignment notch, and the lock tab is inserted between the spaced flanges of the female slide lock; and
the inner protrusion of the lock tab is biased into contact with the lower ridge by the spring acting against the lower panel, the upper spring member is at least partially aligned with the lock aperture and a distal end of the upper spring member is engaged with the inner lip such that the cap is held in place on the sleeve by engagement with the upper end of the slide;
wherein the cap can be disassembled from the upper end of the sleeve by:
removing the lock tab from the cap and breaking the frangible portion to disengage the inner protrusion from the lower ridge;
compressing the spring on the bottom leg against the lower panel to raise the upper end of the slide within the slide channel and move the distal end of the upper spring member out of alignment with the inner lip of the lock aperture; and
disengaging the slide channel from the cap by depressing the upper spring member through the lock aperture and simultaneously removing the cap from the upper end of the sleeve to open the interior space.

2. A linked set of container units, comprising:
a first container unit, the connectable safety container of claim 1 being the first container unit;
a second container unit, the second container unit being a second connectable safety container having a male slide lock and a female slide lock;
the male slide lock including a pair of spaced flanges, each of the spaced flanges of the male slide lock having an outwardly sloped face; and
the female slide lock including a pair of spaced flanges, each of the spaced flanges of the female slide lock having an inwardly sloped face;
wherein the male slide lock of the second container unit is configured to be coupled with the female slide lock of the first container unit by sliding the spaced flanges of the male slide lock between the spaced flanges of the female slide lock with the outwardly sloped faces slidingly engaged with the inwardly sloped faces thereof; and
wherein the female slide lock of the second container unit is configured to be coupled with the male slide lock of the first container unit by sliding the spaced flanges of the female slide lock over the spaced flanges of the male slide lock with the inwardly sloped faces slidingly engaged with the outwardly sloped faces thereof.

3. A connectable safety container comprising:
a cap comprising:
a lock tab including a protrusion; and
a lock aperture;
a sleeve comprising:
an interior space, the interior space accessible through an upper opening; and
a slide channel disposed within and along a first side of the sleeve; and
a slide comprising:
an upper end;
a lower end;
a bottom leg;
a channel leg coupled with the bottom leg at the lower end; and
the upper end including a ridge and a spring member;
wherein in an assembled configuration, the cap is fit over the upper opening of the sleeve to enclose the interior space, the lock tab aligned along the first side of the sleeve, the channel leg is slidingly disposed within the slide channel, the protrusion of the lock tab is engaged with the ridge to prevent movement of the channel leg within the slide channel in at least one direction, and an end of the spring member is engaged within the lock aperture to prevent removal of the cap from the sleeve;
wherein the cap can be disassembled from the upper end of the sleeve by:
disengaging the protrusion from the lower ridge by removing the lock tab from the cap;
advancing the upper end of the channel leg within the slide channel to move the spring member out of engagement with the protrusion;
disengaging the spring member from the lock aperture; and
removing the cap from the upper end of the sleeve.

4. The connectable safety container of claim 3, wherein the lock aperture includes an inner lip and an end of the spring member engages with the inner lip in the assembled configuration to prevent removal of the cap from the sleeve, and advancing the upper end of the slide within the slide channel disengages the end of the spring member from the inner lip and allows the spring member to be depressed.

5. The connectable safety container of claim 3, wherein the lock tab is attached with a lower lip of the cap by a frangible portion.

6. The connectable safety container of claim 3, wherein the protrusion is on an inner face of the lock tab.

7. The connectable safety container of claim 3, wherein the cap includes an alignment tab extending downwardly from a lower lip and the sleeve includes an alignment notch, the alignment tab disposed within the alignment notch in the assembled configuration.

8. The connectable safety container of claim 3, wherein the sleeve includes a lower panel and a bottom recess below the lower panel, and the bottom leg is disposed within the bottom recess and the spring member engages with the lower panel to bias the ridge into engagement with the protrusion in the assembled configuration.

9. The connectable safety container of claim 3, further comprising a male slide lock disposed along a second side of the sleeve and a female slide lock disposed along the first side of the sleeve, the male slide lock configured to engage with a female slide lock of a second container unit and the female slide lock configured to engage with a male slide lock of a third container unit.

10. The connectable safety container of claim 9, wherein each of the male slide locks include a pair of spaced flanges having outwardly sloped faces and each of the female slide locks include a pair of spaced flanges having an inwardly sloped faces.

11. The connectable safety container of claim 10, wherein:

the male slide locks are configured to be coupled to respective female slide locks by aligning an upper end of the spaced flanges of a respective male slide lock between a the spaced flanges of the respective female slide lock at a lower end thereof and sliding the spaced flanges of a respective male slide lock into the spaced flanges of the respective female slide lock.

12. A linked set of container units comprising:

a plurality of container units, each container unit comprising:

a cap;

a slide; and a sleeve comprising:

an interior space and an upper opening into the interior space, the cap configured to enclose the interior space;

a female slide lock disposed along a first side of the sleeve and including a pair of spaced flanges;

a male slide lock disposed along a second side of the sleeve, opposite the first side, the male slide lock including a pair of spaced flanges;

wherein in an assembled configuration, the female slide lock of a first container unit of the plurality of container units is configured to be coupled with the male slide lock of a second container unit of the plurality of container units by sliding the spaced flanges of the male slide lock between the spaced flanges of the female slide lock;

wherein:

the cap includes a lock aperture and a lock tab having an inner protrusion;

the sleeve includes a slide channel along the first side and a lower panel;

the slide includes a bottom leg having a spring and a channel leg having a ridge and a spring member, the channel leg disposed within the slide channel;

the inner protrusion of the lock tab engages the ridge to prevent movement of the channel leg within the slide channel in at least one direction;

an end of the spring member is engaged within the lock aperture to prevent removal of the cap from the sleeve; and the spring engages the lower panel to bias the inner protrusion into contact with the ridge and the lock aperture into contact with the spring member.

13. The linked set of container units of claim 12, wherein in the assembled configuration, the male slide lock of the first container unit is configured to be coupled with the female slide lock of a third container unit of the plurality of container units by sliding the spaced flanges of the male slide lock between the spaced flanges of the female slide lock.

14. The linked set of container units of claim 12, wherein the male slide lock is configured to be coupled to the female slide lock by aligning an upper end of the male slide lock with a lower end of the female slide lock and sliding the spaced flanges of the male slide lock between the spaced flanges of the female slide lock.

15. The linked set of container units of claim 14, wherein an upper end of the female slide lock is blocked by the cap assembled on the sleeve in the assembled configuration.

16. The linked set of container units of claim 12, wherein the cap of the first container unit is aligned with the cap of the second container unit in the assembled configuration.

17. The linked set of container units of claim 16, wherein a first side of the cap of the first container unit includes a lock aperture and access to the lock aperture is blocked by the cap of the second container unit in the assembled configuration.

18. The linked set of container units of claim 12, wherein each of the male slide locks includes a pair of spaced flanges having outwardly sloped faces and each of the female slide locks includes a pair of spaced flanges corresponding to the spaced flanges of the male slide locks and having inwardly sloped faces.

19. The container units of claim 12, wherein the cap can be disassembled from the sleeve by:

disengaging the inner protrusion from the lower ridge by removing the lock tab from the cap;

depressing the spring against the lower panel and advancing the channel leg within the slide channel to move the spring member out of engagement with the lock aperture;

depressing the spring member through the lock aperture; and removing the cap from the upper end of the sleeve.

* * * * *